US007581640B2

(12) United States Patent
Lopez

(10) Patent No.: US 7,581,640 B2
(45) Date of Patent: Sep. 1, 2009

(54) REUSABLE BEVERAGE CUP WITH COUNTER

(75) Inventor: Carlos A. Lopez, Miami, FL (US)

(73) Assignee: Productopop, Inc., Miami, FL (US)

( * ) Notice: Subject to any disclaimer, the term of this patent is extended or adjusted under 35 U.S.C. 154(b) by 129 days.

(21) Appl. No.: 11/973,967

(22) Filed: Oct. 11, 2007

(65) Prior Publication Data

US 2009/0095645 A1 Apr. 16, 2009

(51) Int. Cl.
*B65D 85/72* (2006.01)

(52) U.S. Cl. ..... 206/459.1; 220/288; D7/507; D7/511; D7/619.1

(58) Field of Classification Search ..... D07/507, D07/509, 511, 602, 619.1, 619.2, 620, 621, D07/622, 623; 206/459.1, 459.5; 220/288, 220/737, 739

See application file for complete search history.

(56) References Cited

U.S. PATENT DOCUMENTS 2,450,949 A * 10/1948 Gattuccio et al. ..... 116/308
2,713,845 A * 7/1955 Silverman ..... 116/308
3,285,459 A * 11/1966 Gahm ..... 220/8
D224,778 S * 9/1972 Cocci ..... D10/46.2
3,996,879 A * 12/1976 Walton ..... 116/308
4,037,719 A * 7/1977 Perlmutter ..... 206/266
4,548,157 A * 10/1985 Hevoyan ..... 116/308
4,634,012 A * 1/1987 Kelley ..... 215/203
4,877,119 A * 10/1989 Hosking ..... 206/459.1
4,951,596 A * 8/1990 Wallace, Jr. ..... 116/321
D314,689 S * 2/1991 Claudias ..... D7/507
5,009,338 A * 4/1991 Barker ..... 215/230
5,174,473 A * 12/1992 Marelli ..... 222/38
D333,066 S * 2/1993 Kimpson ..... D7/509
5,190,643 A * 3/1993 Duncan et al. ..... 210/85
5,280,834 A * 1/1994 Berkley ..... 206/5.1
D350,457 S * 9/1994 Bailey ..... D7/622
5,356,012 A * 10/1994 Tang et al. ..... 206/534
5,377,614 A * 1/1995 Glazer ..... 116/308
5,400,907 A * 3/1995 Chen ..... 206/459.1
5,492,246 A * 2/1996 Bailey ..... 220/756
5,607,078 A * 3/1997 Nordberg et al. ..... 220/756
5,644,298 A * 7/1997 Brooks et al. ..... 340/612
5,678,712 A * 10/1997 Rios ..... 215/220
5,803,283 A * 9/1998 Barker et al. ..... 215/230
5,845,777 A * 12/1998 Najmi ..... 206/459.1
5,860,387 A * 1/1999 Giveen ..... 116/285
D404,969 S * 2/1999 Krenzler ..... D7/507
5,881,597 A * 3/1999 Brooks ..... 73/428
5,896,990 A * 4/1999 Barzana ..... 206/459.1
5,979,698 A * 11/1999 Deal ..... 221/2
6,003,467 A * 12/1999 Shelton-Ferrell et al. .... 116/309

(Continued)

*Primary Examiner*—David A. Rogers
(74) *Attorney, Agent, or Firm*—Bauman, Dow & León, P.C.; Alberto A. León, Esq.

(57) ABSTRACT

The present invention discloses a beverage cup that comprises a cup body, and a lid. The lid comprises a hinged plug insert, which covers the drinking port in the lid, a window and a counter means. The counter means comprises a disc that protrudes through the outer circumference of the lid in such a way that the user can rotate the disc. The disc is printed with symbols or numbers, one of which is visible at a time through the window in the lid. Different symbols or numbers on the disc are visible through the window as the disc is rotated.

8 Claims, 3 Drawing Sheets

U.S. PATENT DOCUMENTS 6,016,764 A * 1/2000 Giveen ..... 116/284
6,206,229 B1 * 3/2001 Harjes ..... 220/669
6,252,494 B1 * 6/2001 Howell ..... 340/309.8
6,336,453 B1 * 1/2002 Scarrott et al. ..... 128/200.23
D477,500 S * 7/2003 Smith ..... D7/515
D504,796 S * 5/2005 Schuler et al. ..... D7/392.1
7,004,105 B2 * 2/2006 Bucksch ..... 116/227
7,021,486 B1 * 4/2006 Hurlbut ..... 220/379
7,201,840 B2 * 4/2007 Tsataros et al. ..... 210/85
D552,926 S * 10/2007 Yelland ..... D7/392.1
2005/0017020 A1 * 1/2005 Eckert ..... 222/30
2005/0127075 A1 * 6/2005 Smith et al. ..... 220/253
2006/0278156 A1 * 12/2006 Miller ..... 116/112
2007/0062277 A1 * 3/2007 Miller ..... 73/428
2007/0246042 A1 * 10/2007 Purkins et al. ..... 128/200.14

* cited by examiner

REUSABLE BEVERAGE CUP WITH COUNTER

BACKGROUND OF THE INVENTION

1. Technical Field of the Invention

This invention generally relates to beverage containers. More specifically, this invention relates to drinking cups. Still more particularly this invention relates to a multifunction beverage drinking cup with a counter.

2. Description of the Background Art

It has been widely believed for a long time that drinking at least eight 8-ounce glasses of water daily was a requirement to stay healthy. Some publications and health care experts have disputed the need to consume that exact amount. However, it is undisputed that there are beneficial health effects attendant with being adequately hydrated. There have been numerous studies which have correlated the decreased risk of certain cancers, notably colon cancer, with an increased water intake. Other proven health benefits derived from proper hydration include improved kidney, digestive and nutritional functions.

Recently there has been a significant increase in water-drinking and water container-carrying. People carrying fluid containers in public, especially water, has become an every day sight. In addition, there has been a huge proliferation of sports drinks, natural juices and nutritional beverages. The exponential increase of people carrying water and other beverages in public has resulted in an equal increase in the variety of fluid containers used. Many people wash and reuse the plastic bottles which originally contained the distilled or spring water consumed. Others purchase and use reusable fluid containers. Most known reusable fluid containers do not have good thermal qualities and deteriorate with continuous use and washing.

At least one patent has issued for a water glass reminder. U.S. Pat. No. 5,845,777 to Najmi disclosed and claimed a clear plastic ten ounce glass equipped with a rotatable disc or ring at its base for indexing from one number to the other as water is consumed. In contrast, the present invention comprises a new and useful drinking cup, equipped with a lid. The lid comprises a counting mechanism. An object of the present invention is to provide a new and improved beverage drinking container cup capable of counting the amount and number of cups of fluid drunk by the user in a given period of time.

Another object of the present invention is to provide a beverage drinking container cup with optimal thermal capabilities that is sufficiently resistant to endure multiple uses and washings.

SUMMARY OF THE INVENTION

The apparatus of the present invention comprises an insulated and thermally efficient plastic or metal drinking cup that is generally cylindrical in shape. The cup's shape is ergonomically efficient for ease of carrying and handling. The cup comprises a lid that is tightly threaded or snapped into place to cover the top of the cup to prevent spilling. The lid comprises a raised ridge along its outer circumference to prevent liquid from spilling down the sides of the cup, an opening near the edge through which the beverage in the cup can pass, and an insert that snaps into the center of the lid. The insert comprises a rubbery plug that mates to the opening in the lid, the insert being so shaped so that when fully open, can be engaged to an opening on the lid's ridge placed opposite to the lid's opening to prevent the insert from moving when the user is consuming liquid. The lid also comprises a window on its top surface and a housing between its top and bottom surfaces capable of receiving a counter means. The counter means comprises a disc with numbers or symbols printed on it, which protrudes through a slit or opening in the side of the lid. The outer perimeter of the disc comprises serrations. The disk fits inside the lid's housing so that enough of the disc protrudes through the lid's side slit or opening to make it possible for the user to manually rotate the disk and change the number or symbol which appears on the lid's window.

DETAILED DESCRIPTION OF THE PREFERRED EMBODIMENT OF THE INVENTION

Figure 1:
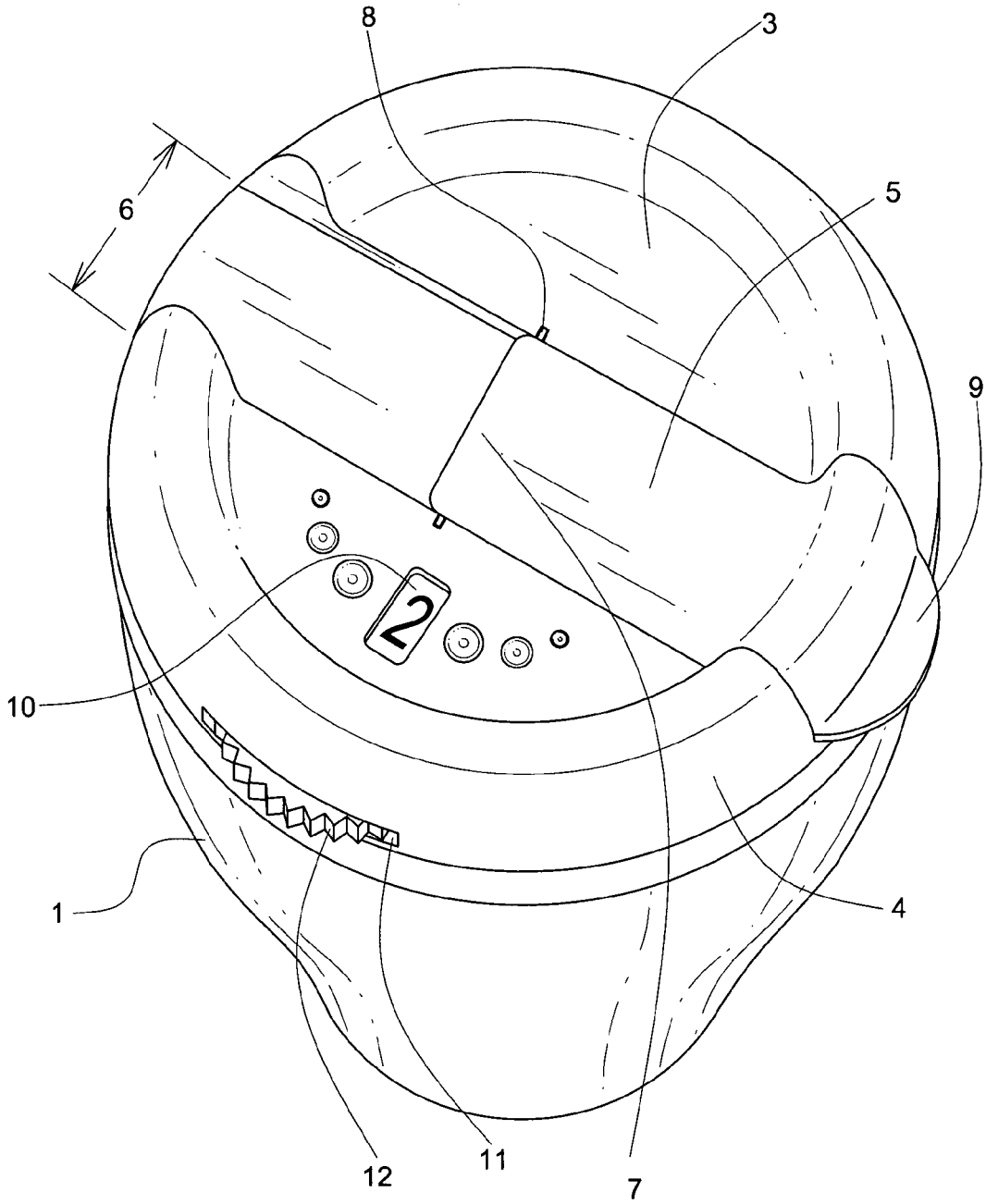
FIG. 1: is a perspective view of the preferred embodiment of the invention.
Figure 2:
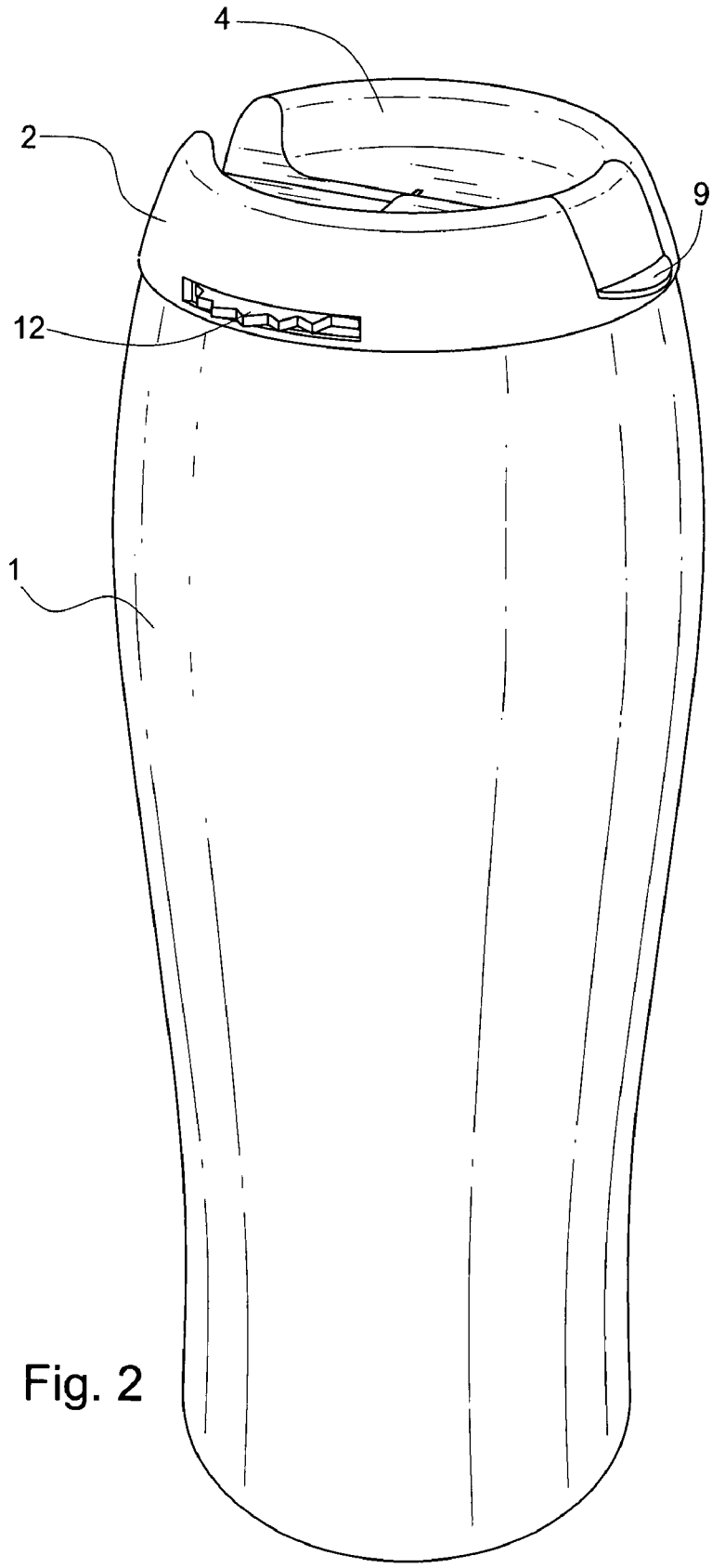
FIG. 2: is a top view of the preferred embodiment of the invention.
Figure 3:
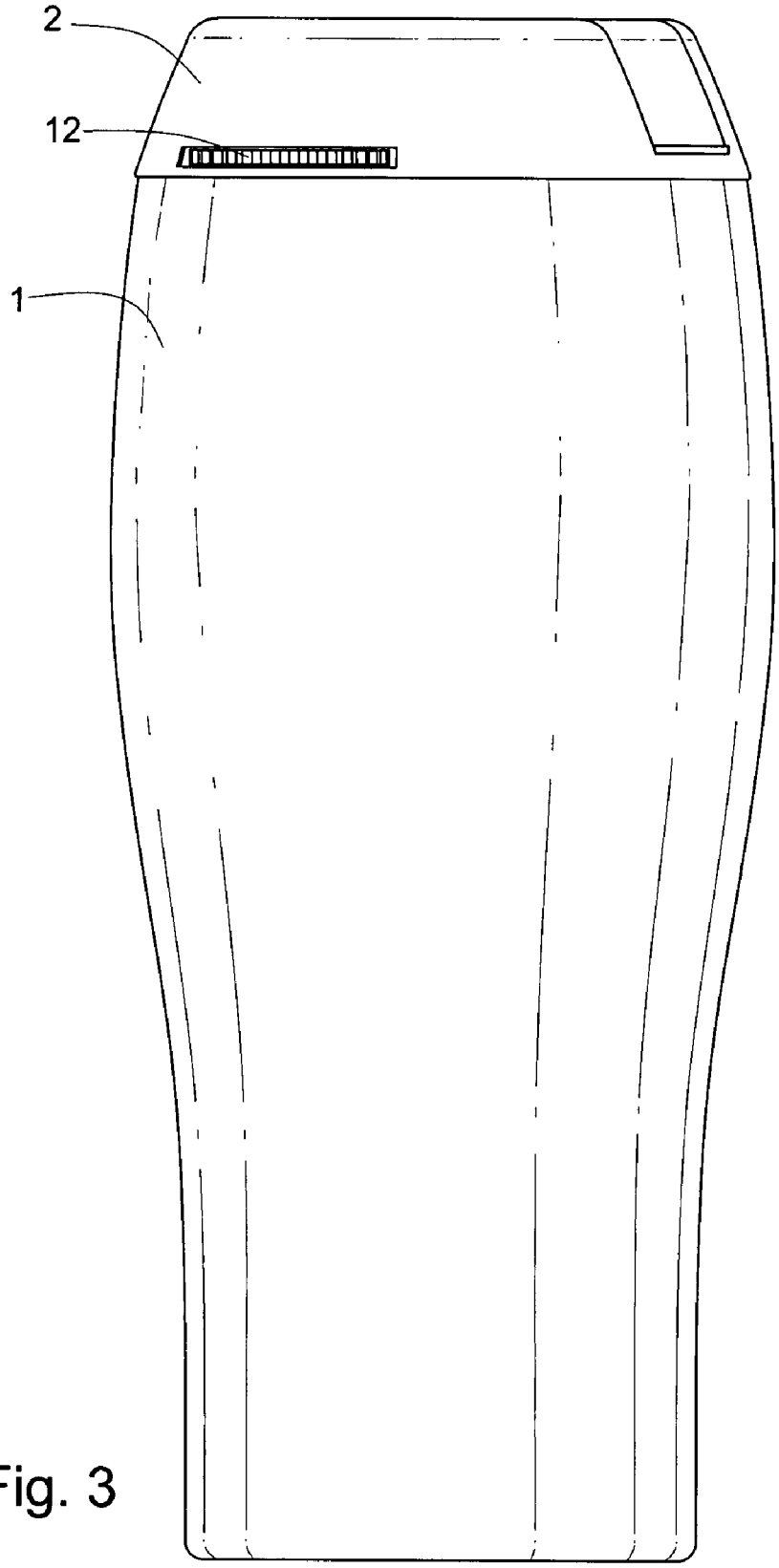
FIG. 3: is a side view of the preferred embodiment of the invention.

The preferred embodiment of the invention comprises a cup body (1) and a lid (2), which are manufactured of injection molded plastic. In alternative embodiments, all or parts of the invention may be manufactured from metal or plastic covered with a layer of metal. The cup body is preferably insulated to maintain the temperature of the beverage inside of it.

The cup body (1) is generally cylindrical and is comprised of a top side, a base, an exterior surface and an interior surface. The base comprises an outer circumference and a center. The outer circumference is raised with respect to the center, stabilizing the cup even if the bottom surface is uneven. The top side of the cup comprises an opening and a threaded rim capable of receiving a threaded lid. In an alternative embodiment of the invention, the exterior surface of the cup body further comprises a handle means.

The lid (2) comprises an outer side (3), an inner side, a raised outer circumference (4), a housing for the counter means and a hinged plug insert (5). The inner side of the lid is threaded and capable of securely engaging the threaded rim on the top side of the cup body. The raised outer circumference (4) is non-contiguous and comprises a gap (6), where its level is not raised above the outer side of the lid. The outer side of the lid comprises a relieved area capable of fully nesting the hinged plug insert in both its open and closed positions. The relieved area comprises a first end, a second end and two sides. The first end terminates at the gap (6) in the raised outer circumference, the gap being as deep as the relieved area. The second end terminates at the raised outer circumference and comprises a drinking port near the raised outer circumference and opposite to the gap. The drinking port comprises an opening from the inner side of the lid to the outer side of the lid. The port is of a size and shape appropriate for the passage of a beverage without spilling into the mouth of the user when the user presses the lower lip of the mouth onto the raised outer circumference and tilts the base of beverage cup upward. Each side of the relieved area comprises a press-fit hinge relief groove. The grooves are directly opposite each other and are capable of firmly engaging the hinged plug insert (5).

The hinged plug insert (5) is capable of fully nesting in the relieved area of the outer side of the lid when it is in either the open or closed position. The hinged plug insert comprises an interior end (7), an exterior end, a top side, and a bottom side. The interior end comprises a press-fit hinge and terminates in a rounded edge. The press-fit hinge (8) engages the press-fit hinge relief grooves in the relieved area of the lid. The press-fit hinge comprises two projections, which are sized to be capable of snapping into the press-fit hinge relief grooves and remaining securely within the relief grooves. When the press-fit hinge (8) is snapped into the relief grooves, the rounded edge of the interior end (7) allows the hinged plug insert to rotate axially about the exterior of the lid from a closed to an open position. The bottom side of the hinged plug insert comprises a rubberized drinking port plug located near its exterior end. The shape and location of the drinking port plug enables it to mate firmly with the drinking port when the hinged plug insert is in the closed position. The rubbery material ensures that the beverage in the cup cannot pass through the drinking port when the drinking port plug is firmly engaged with the drinking port. The exterior end of the hinged plug insert (5) comprises an arched section and an opening/closing flange (9). The arched section is shaped to lock onto the raised outer circumference of the lid when the hinged plug insert is in the closed position. The width of the arched section matches the specific arc degree of the gap in the raised outer circumference of the lid. When the hinged plug insert is in the open position, the arched section extends through the gap, allowing the hinged plug insert to be fully nested in the relieved area of the lid and the bottom of the hinged plug insert to be flush with the outer side of the lid. The exterior end of the hinged plug insert terminates in an opening/closing flange (9). The opening/closing flange is preferably parallel with the outer side of the lid when the hinged plug insert is in the open or closed position. The opening/closing flange acts as a handle for grasping and rotating the hinged plug insert about the press-fit hinge (8).

The lid also comprises a window (10) on its outer side and a horizontal slit (11) on its outer circumference capable of receiving a counter means. The lid's window comprises an opening through the outer side of the lid. In the preferred embodiment of the invention, the window further comprises a transparent cover made of plastic or glass that envelops the opening, preventing debris from entering the opening. The counter means comprises a disc (12) with numbers or symbols printed on its inner perimeter. The numbers or symbols are located on the disc in a position where one symbol or number at a time shows through the window in the lid's outer side. In the preferred embodiment, the disc has a larger diameter than the horizontal slit (11) in the lid, so it must be inserted into the housing during production of the lid. The disc (12) fits inside the lid's housing so that enough of the disc protrudes from the slit to make it possible for the user to rotate the disk and change the number or symbol which appears on the lid's window. The disc (12) comprises an outer perimeter and a center. The disc's outer perimeter is serrated. The disc's center comprises a hole through the disc. The counter means further comprises a retaining means and a click-in-place means. The retaining means is capable of extending through the hole in the center of the disc in such a way that the disc can spin freely around the retaining means. The retaining means comprises a molded male projection in the inner or outer side of the lid that projects into the housing and may comprise a molded female dimple in the other side of the lid. The male projection and the female dimple come in contact with one another when the lid is assembled. In alternative embodiments of the invention, the retaining means comprises a retaining pin capable of being inserted through the center of the disc. The retaining pin comprises a first end and a second end. The first end is capable of being held in place by a dimple in the outer side of the lid and the second end is capable of being held in place by a dimple in the inner side of the lid when the lid is assembled. The click-in-place means comprises a vertical arm fixedly attached to the inner side of the lid, which projects into the housing, coming into contact with the disc. The click-in-place means is placed in such a way that it catches on the serrations of the disc's (12) outer perimeter as the disc is rotated, requiring the user to apply firm pressure when turning the disc to change the number and preventing the number from changing without a deliberate act on the part of the user. In an alternative embodiment of the counter means, the disc (12) comprises a plurality of indentations on one side. The arm of the click-in-place means is placed in such a way that it is capable of protruding into the indentations on the disc, holding it in position until directional pressure is applied to the serrated edge of the disc. The indentations would correspond to the numbers in the window (10), so that when the arm protrudes into an indentation a number is held in position in the window. In another alternative embodiment of the counter means, the counter means comprises two discs with serrated outer perimeters that are capable of interlocking in the same fashion as two gears, so that when one disc is rotated in one direction, the other disc rotates in the other direction. Each disc further comprises a center with a hole capable of receiving a retaining means, as in the preferred embodiment. The first disc is smaller and protrudes from the horizontal slit (11) in the lid far enough that the user can turn the disc. The second disc is larger than the first and is completely internal to the lid. It comprises a top surface and a bottom surface. The top surface of the second disc is printed with a circular series of symbols or numbers. The symbols or numbers are located on the disc where one symbol or number at a time shows through the window (10) in the lid, and different symbols or numbers show through the window as the first disc is rotated by the user, resulting in the second disc rotating. A click-in-place means keeps the number or symbol centered in the window as in the preferred embodiment. The click-in-place means can interface with either of the two discs. Alternative embodiments of the click-in-place means can also be used with this embodiment.

What is claimed is:

1. A beverage cup comprising:

a. a generally cylindrical body, the body comprising a top side, a base, an exterior surface and an interior surface, the top side comprising an opening and a rim, the rim comprising threads and being capable of receiving a lid, the base of the cup body comprising a molded stability rim;

b. a lid, the lid comprising an outer side, an inner side, a raised outer circumference and a housing, the inner side being threaded and capable of firmly engaging the top side of the cup body, the raised outer circumference being raised above the level of the outer side of the lid in a non-contiguous fashion, the raised outer circumference comprising a gap, the raised outer circumference further comprising a horizontal slit that opens into the housing, the outer side of the lid comprising a window, the outer side of the lid further comprising a relieved area, the relieved area comprising a first end, a second end and two sides, the first end terminating in the gap of the raised circumference, the second end comprising a drinking port opposite to the position of the gap in the raised outer circumference, the drinking port comprising an opening from the inner side to the outer side of the lid of a size and shape appropriate for the passage of a beverage, each side of the relieved area comprising a press-fit hinge relief groove, the two grooves being opposite each other;

c. a counter means capable of fitting within the lid's housing, the counter means comprising a disc, a retaining means and a click-in-place means, the disc comprising a serrated outer circumference and a center, the disc being capable of fitting into the housing located between the outer side and inner side of the lid with a portion of the outer circumference of the disc protruding through the horizontal slit, the disc further comprising a plurality of printed numbers or symbols printed between the outer circumference and the center in a location where one number or symbol at a time is visible through the window in the outer side of the lid and the other numbers or symbols can be moved into the window by the user as the disc is rotated where it projects through the protrusion, the disc's center comprising a hole, the retaining means comprising a molded male projection fixedly attached to the housing, the projection being capable of extending through the hole in the center of the disc in such a way that the disc can spin freely around the retaining means, the counter means further comprises a click-in-place means capable of preventing the disc from moving without directional pressure on its outer perimeter, the click-in-place means comprising a vertical arm fixedly attached to the housing, the vertical arm being placed in such a way that it protrudes into the serrations of the discs outer perimeter; and d. a hinged plug insert being capable of fully nesting in the relieved area of the outer side of the lid in both an open or closed position, the hinged plug insert comprising an interior end, a center, an exterior end, a top side and a bottom side, the interior end comprising a press-fit hinge and a rounded edge, the press-fit hinge comprising two projections sized to firmly snap into the press-fit hinge relief grooves, the press-fit hinge terminating in the rounded edge allowing the hinged plug insert to rotate axially about the exterior of the lid, the bottom side comprising a rubberized drinking port plug near the exterior end, the drinking port plug being shaped and located in such a way that it mates firmly with the drinking port, the drinking port plug being capable preventing a beverage from passing through the drinking port when mated with the drinking port, the exterior end comprising an arched section and an opening/closing flange, the arched section being shaped to lock onto the raised circumference of the lid and matching the specific arc degree of the gap of the raised circumference, the exterior end terminating in the opening/closing flange.

2. A beverage cup according to claim 1, wherein a handle means is fixedly attached to the exterior surface of the cup body.

3. A beverage cup according to claim 1, wherein the window in the lid comprises a transparent cover.

4. A beverage cup according to claim 1, wherein all or parts of the cup are manufactured from metal.

5. A beverage cup according to claim 1, wherein all or parts of the cup are manufactured from injection-molded plastic.

6. A beverage cup according to claim 1, wherein the body is thermally insulated.

7. A beverage cup according to claim 1, wherein the disc of the counter means comprises a plurality of indentations on one side, the placement and number of the indentations corresponding to the symbols or numbers on the opposite side of the disc, and the vertical arm of the click-in-place means is placed in such a way that it is capable of protruding into the indentations on the disc, holding the disc in place unless firm pressure is applied to rotate the disc.

8. A beverage cup according to claim 1, wherein the counter means comprises two discs capable of interfacing as two gears, the first disc comprising a serrated outer perimeter and a center, the second disc comprising a serrated outer perimeter a center, an top surface and a bottom surface, the top surface comprising a plurality of printed numbers or symbols printed in a circle, the centers of the first and second discs comprising holes, the counter means further comprising two retaining pins, each capable of being inserted through the center hole of a disc, the counter means further comprising a click-in-place means.

* * * * *